United States Patent [19]

Rusbach

[11] 4,320,706

[45] Mar. 23, 1982

[54] PERCUSSION HEAD FUSE FOR AN EXPLOSIVE PROJECTILE

[75] Inventor: Maurice Rusbach, Nyon, Switzerland

[73] Assignee: Sarmac S.A., Geneva, Switzerland

[21] Appl. No.: 85,287

[22] Filed: Oct. 16, 1979

[30] Foreign Application Priority Data

Dec. 22, 1978 [CH] Switzerland ..... 13088/78

[51] Int. Cl.[3] ..... F42C 15/24

[52] U.S. Cl. ..... 102/249; 102/253

[58] Field of Search ..... 102/247–249, 102/251–253, 275, 276, 222

[56] References Cited

U.S. PATENT DOCUMENTS

| | | | |
|---|---|---|---|
| 644,321 | 2/1900 | Gathmann | 102/222 |
| 1,216,834 | 2/1917 | Moren | 102/222 |
| 1,449,245 | 3/1923 | Pinkerton | 102/252 |
| 1,687,341 | 10/1928 | Lukens et al. | 102/222 |
| 2,595,757 | 5/1952 | Brandt | 102/249 |
| 2,772,635 | 12/1956 | Brandt | 102/253 X |
| 2,845,866 | 8/1958 | Jasse | 102/253 |
| 3,858,515 | 1/1975 | Rusbach | 102/248 X |
| 4,212,245 | 7/1980 | Rusbach | 102/249 |

FOREIGN PATENT DOCUMENTS

| | | | |
|---|---|---|---|
| 243651 | 3/1965 | Austria | 102/248 |
| 830370 | 5/1938 | France | 102/248 |
| 1194949 | 5/1959 | France . | |

*Primary Examiner*—David H. Brown
*Attorney, Agent, or Firm*—Young & Thompson

[57] ABSTRACT

It comprises a cylindrical body 1 which is intended to be fixed on an explosive projectile. A detonator 12 comprising a casing 13 whose rearward portion serves as armor plating 13' is mounted slidably in a casing 11 which is fixed coaxially in the cylindrical body, from an inactive position within the casing 11 to an active position within a case member 18 which extends the casing 11 rearwardly and which is disposed in the operating position within the explosive charge 4 of the projectile. In the inactive position, the detonator is retained by balls 19 which are partially engaged in a groove 16 provided in a cover 15 which extends the detonator in a forward direction, and emerge from openings 20 provided in the wall of the casing 11. The balls are held in position by the bore of an arming inertia weight member 21 which is mounted slidably outside of the casing 11 and which is subjected to a resilient action and to retardation of its movement in a forward direction. A striker 9 is fixed to the forward end of a member of revolution which is axially fixed with respect to the cylindrical body, said member of revolution 6 also containing a movable primer which is subjected to a resilient action tending to hold it at a spacing from the striker.

7 Claims, 12 Drawing Figures

FIG.1
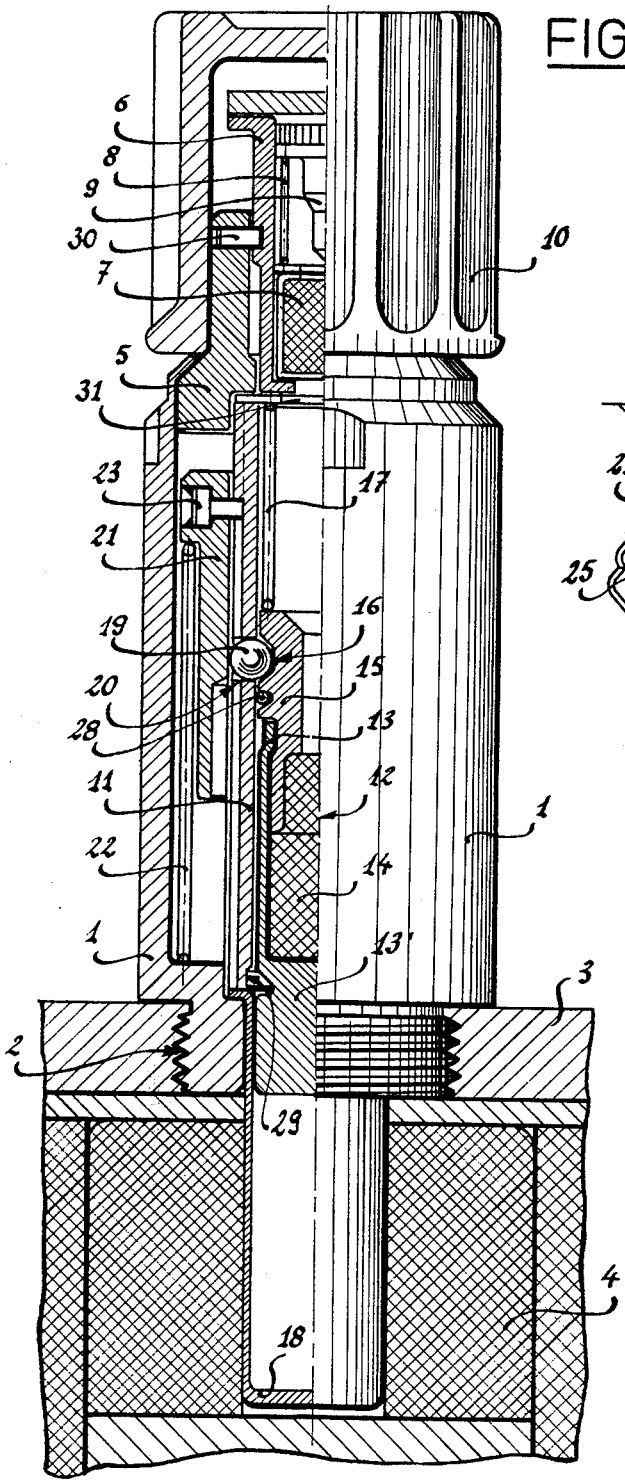
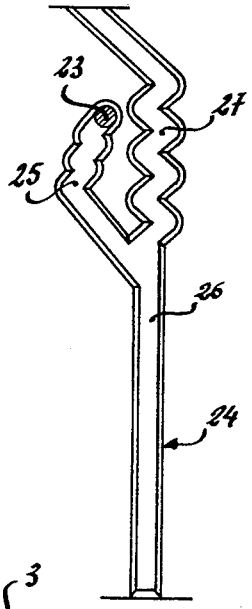
FIG.1a

FIG.2
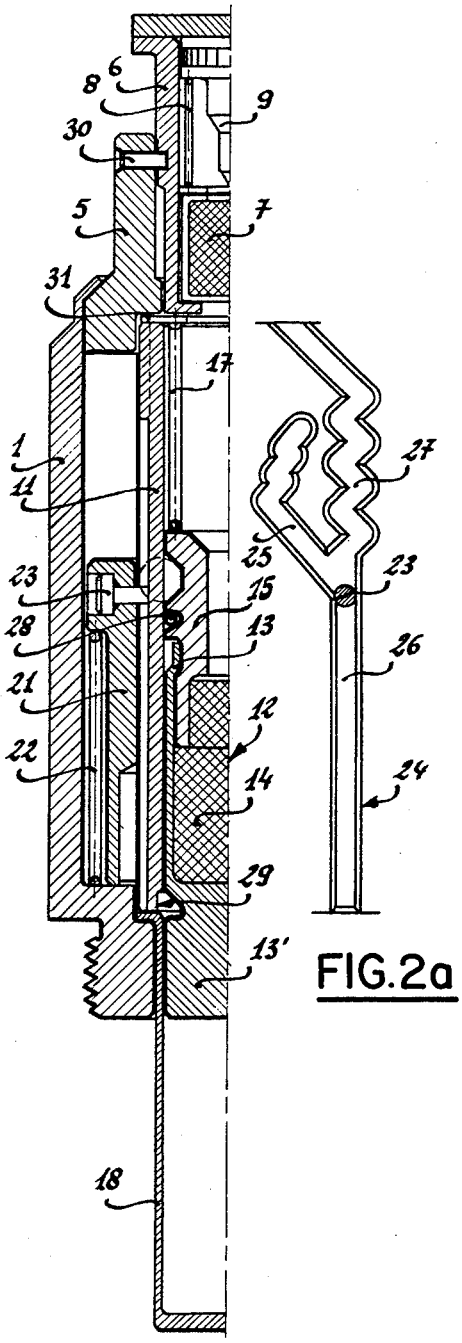
FIG.2a
FIG.3
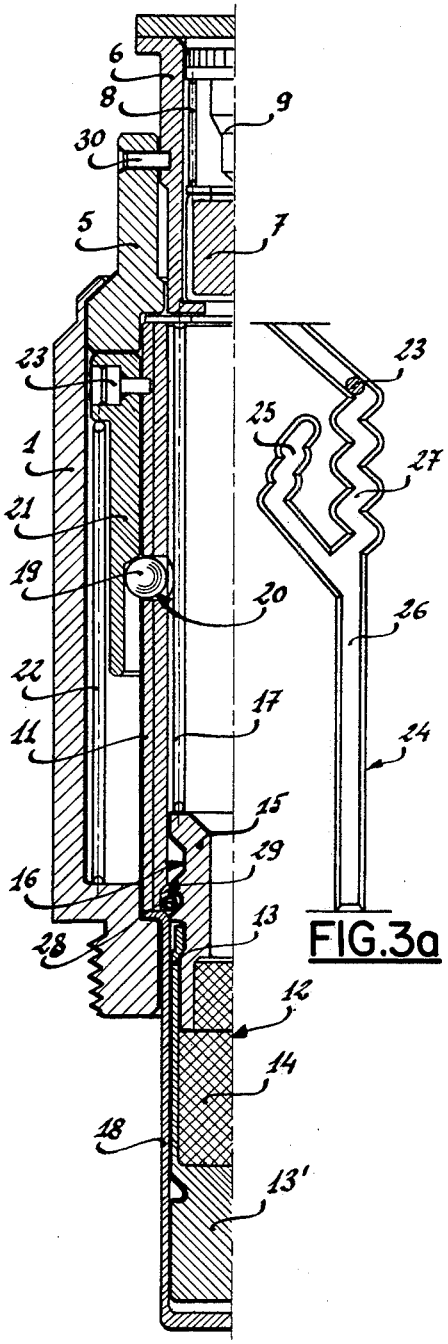
FIG.3a

FIG.4
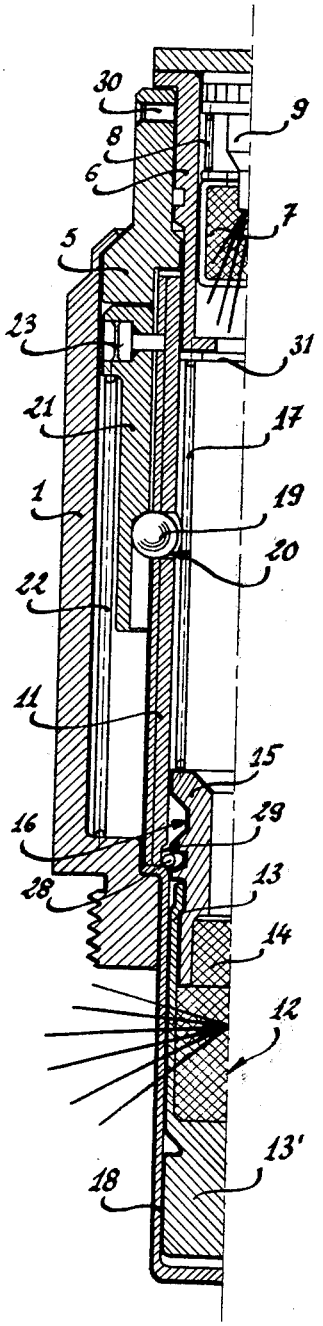
FIG.5
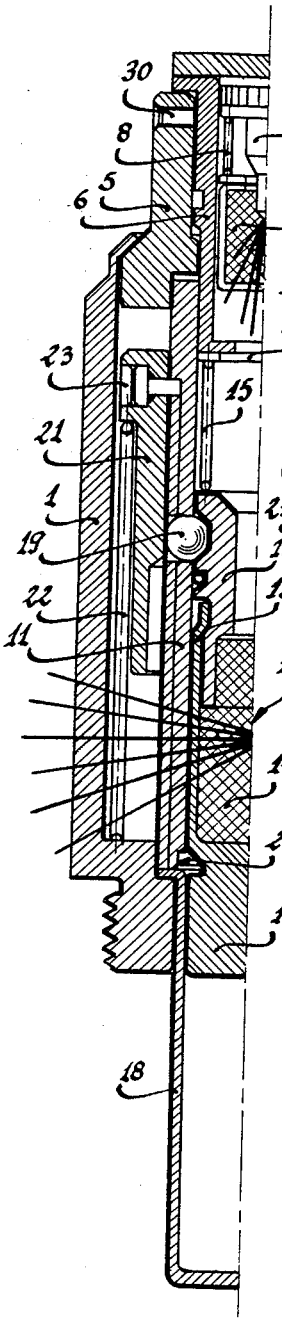
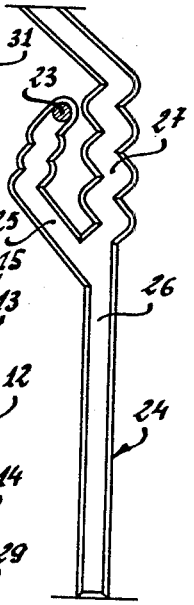
FIG.4a

PERCUSSION HEAD FUSE FOR AN EXPLOSIVE PROJECTILE

The present invention relates to a percussion head fuse with an out-of-charge detonator for an explosive projectile, in particular for a rifle grenade.

The head fuses which are intended to be used on small explosive projectiles which have a low initial speed, such as rifle grenades, light mortar shells, small-calibre rockets, etc. must include, in addition to the mechanisms which are inherently required for functioning thereof, a series of devices which provide the safety measures required for use without danger, for example, muzzle safety by virtue of a delay in arming, safety in the event of the projectile being dropped or crushed when being transported, etc. It is for this reason that most of the known fuses are highly complex in design and construction and include troublesome, delicate, heavy and bulky mechanical and/or electronic devices.

The aim of the present invention is consequently to provide a percussion head fuse for an explosive projectile, which is simple in design and manufacture, low in weight and small in bulk, but which nonetheless provides all the safety measures required. The fuse in accordance with this invention therefore seeks to achieve the aboveindicated aim, and is characterised in that it comprises a cylindrical body whose rearward end has fixing means intended to co-operate in the operating position with corresponding means of the front end of the projectile and is provided with a case member which axially extends said body, said case member being disposed in the operating position within the explosive charge of the projectile, that a detonator comprising a casing means whose rearward portion is reinforced and serves as armour-plating, a charge and locking means at its forward portion, is mounted displaceable within a casing which is coaxially fixed within the body, by an axial sliding movement from an inactive position wherein the armour plating is disposed in front of said fixing means of the cylindrical body and the detonator is within the casing, to an active position wherein the detonator is within said case member, and that it further comprises an arming inertia weight member which is mounted slidably outside of the casing so as to co-operate with the locking means of the detonator and which is subjected to a resilient action and to the action of means for retarding its displacement forwardly under the effect of said resilient action, and a member of revolution which is fixed coaxially to the front of the cylindrical body, said member containing an axially movable primer disposed close to the forward end of the casing and a striker disposed at the forward end of said member of revolution, the primer being subjected to a resilient action intended to hold it at a spacing from the striker.

The accompanying drawing diagrammatically illustrates by way of example two embodiments of the fuse according to the invention.

FIG. 1 is a partly sectional view of a first embodiment of the fuse in the rest position, with a detail (FIG. 1*a*) in section of a retarding deflector means.

FIGS. 2, 3 and 4 are cross-sectional views, with a detail (FIGS. 2*a*, 3*a*and 4*a*) of the retarding deflector means, illustrating the mode of operation of the first embodiment shown in FIG. 1, illustrating the arming, armed and percussion positions respectively;

FIG. 5 illustrates the principle of the safety arrangement in respect of being dropped, in the event of accidental percussion;

FIG. 6 is a partly sectional view of a second embodiment with the striker in the inactive position, while

Figure 7:
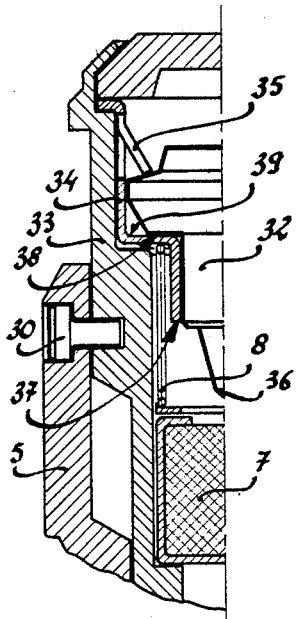
FIGS. 7 and 8 are sectional views on an enlarged scale of the forward part of said second embodiment, with the striker in the active armed position and in the position of percussion on impact respectively.

The first embodiment of the percussion head fuse according to the invention, as illustrated in FIG. 1, comprises a hollow cylindrical body 1 which at its rearward end has a screwthread 2 intended to co-operate with a corresponding screwthread provided in the forward portion 3 of the explosive projectile on which the fuse is mounted and which contains an explosive charge 4. The forward portion of the body 1 is provided with an intermediate ring 5 to which a member of revolution 6 is fixed, the member 6 serving as a support for the percussion device. The percussion device comprises a primer 7 which is mounted slidably in the member 6 adjacent to the forward end of the body 1 and which is subjected to the action of a spring 8, and a striker 9 which is fixed to the forward end of the member 6, the spring 8 holding the primer 7 at a spacing from the striker 9. The percussion device may be protected, in particular during transportation and storage, by a cap 10.

A casing 11 defining a cylindrical internal passage is fixed coaxially within the body 1. A detonator 12 is mounted slidably within the casing 11; the detonator 12 comprises a casing means 13 whose rearward portion is reinforced so as to form an armour plating means 13', a charge 14 and locking means comprising a cover 15 which cooperates with the casing means 13 and which is provided with a groove 16; it is also subjected to the action of a spring 17.

In the inactive position, the detonator 12 is disposed completely within the casing 11, the armour plating means 13' preventing any propagation of the explosive effect in the event of accidental explosion of the detonator 12. This is therefore a device of the kind referred to as an out-of-charge detonator. In the armed operating position, the detonator 12 is disposed in a case member 18 which is fixed to the rear of the body 1 so as to extend the casing 11 and which is disposed completely within the explosive charge 4 when the fuce is in the operating position on the projectile 3. The detonator 12 is held in its inactive position outside the charge by balls 19 which are partially engaged in the groove 16 in the cover 15 of the detonator 12. The balls 19 emerge from passages 20 which are formed in the wall of the casing 11 and are held in the passages 20 by the bore of an arming inertia weight member 21.

The inertia weight member 21 is mounted slidably within the casing 11 and is subjected to the action of a spring 22. It is held in the position of locking the balls 19 by two diametrically opposed projections 23 which cooperate with deflector means 24, and more particularly in the inactive position shown in FIG. 1, with the end of the lateral limb portions 25 formed by the deflector means 24, under the action of the spring 22 (see the detail of a deflector means in FIG. 1).

The mode of operation of this fuse will now be described with reference to FIGS. 2 to 6.

At the beginning of the launch (see FIG. 2), the inertia weight member 21 is moved deeper into its housing under the effect of inertia, compressing the spring 22, with its projections 23 following the path of the side limb portions 25 of the deflector means 24 (see the detail in FIG. 2) which open into the rectilinear portions 26 of the deflector means 24. When the inertia weight member 21 has completed this rearward movement, the inertia weight member 21 is returned in a forward direction by the spring 22.

As the inertia weight member 21 moves forwardly under the action of the spring 22, the inertia weight member 21 is guided by its projections which are firstly disposed in the rectilinear portions 26 of the deflector means 24 and then in the winding or zig-zag portions 27 (see FIG. 3), the purpose of the latter being to provide a delay in the arming action, thereby to provide muzzle safety. At the end of the travel of the inertia weight member 21, the passages 20 are uncovered, thereby allowing the balls 19 to issue from the passages 20. The balls 19 are then thrust aside by the inclined surface of the circular groove 16 under the action of the spring 17, which will then urge the detonator 12, which is thus unlocked, into the case member 18 in the active position in the explosive charge 4, the device then being in the armed position shown in FIG. 3. The detonator 12 is moreover locked in the case member 18, for example by means of a spring ring 28 of circular section, which is disposed in a circular groove provided in the outside surface of the cover 15, and which is partially engaged in a circular groove 29 formed in the inside wall of the rearward end of the casing 11, thus preventing the detonator 12 from moving forwardly again upon impact.

It should be noted that the balls 19 which serve to hold the detonator 12 in the locked inactive position are subjected to forces at the beginning of the launch with an acceleration of from 2000 to 3000 G which are substantial but nonetheless acceptable, neither the groove 16 in the cover 15 of the detonator 12 nor the openings 20 in the casing 11 being damaged.

Upon impact, the striker 9 which is fixed with respect to the member of revolution 6 is urged rearwardly after shearing a locking pin 30 holding the member 6 fixed with respect to the intermediate ring 5 which is itself fixed to the end of the body 1, and a washer 31. By virtue of its inertia, the primer 7 which tends to maintain the speed acquired at the beginning of the launch overcomes the action of the spring 8 and strikes the point of the striker 9, the exploding of which causes explosion of the detonator 12 and thus the explosive charge 4, as shown in FIG. 4.

Muzzle safety, which consists of preventing the grenade from blowing up over a certain safety distance in front of the person firing the projectile is therefore provided in two ways: firstly, by the delay in arming, namely by virtue of the forward-and-return movement of the inertia weight member 21, and then by the time-delay action of the deflector means 24 which retard the movement of the detonator 12 into the charge 4 during the first part of the flight of the projectile, thereby permitting the projectile to cover a safety distance before being armed. The detonator 12 is unlocked only at the end of the movement of the inertia weight member 21, after a 'time loss' caused by the forward-and-return movement of the inertia weight member 21, in addition to the braking effect of the deflector means.

In the event of premature impact within the above-mentioned safety distance, when the detonator 12 is not yet unlocked, the charge 14 explodes in an out-of-charge position, in the casing 11, which has no effect on the explosive charge itself, as shown in FIG. 5, Protection for the explosive charge 4 is further ensured by the provision of the rearward armour plating means 13' provided by the casing means 13 of the detonator.

Figure 6:
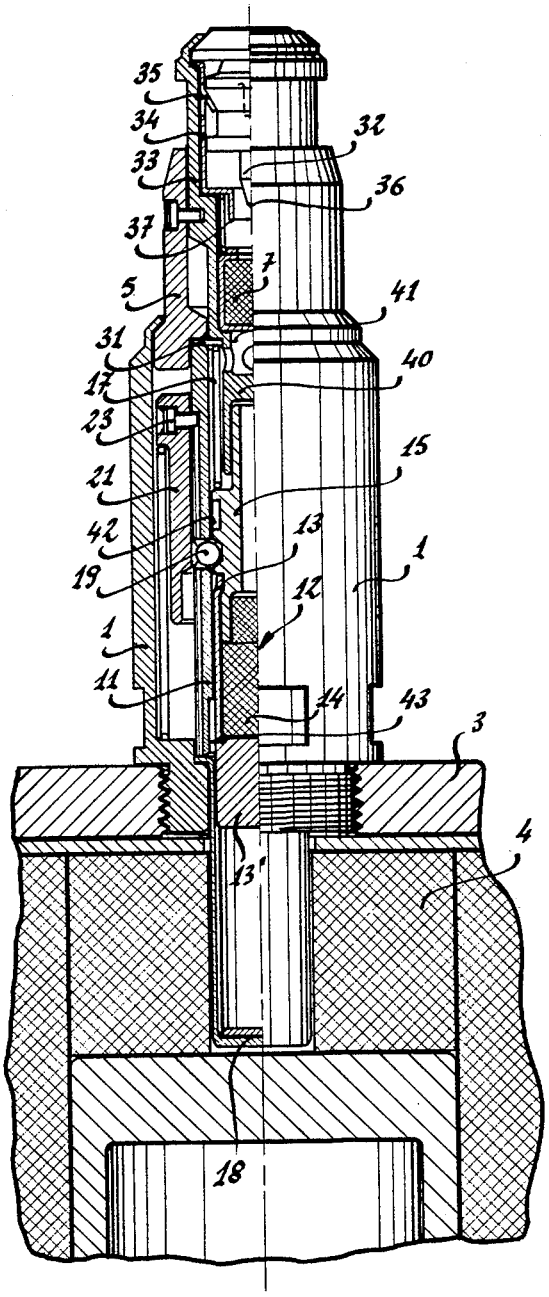

The second embodiment of the fuse according to the invention, as shown in FIGS. 6 and 7, is distinguished from the first embodiment described above, by providing an additional safety measure. In fact, the striker 32 is mounted axially displaceably in the member of revolution 33 from an inactive position (FIG. 6) to an active position (FIG. 7). In the inactive position, the striker 32 which is surrounded by a ring 34 is held in position by radial spring lugs 35 which are formed by displacing portions of the ring 34, in such a way that the point 36 of the striker 32 is disposed forwardly with respect to the rearward circular edge 37 of the ring 34, and thus, in the event of impact due to an accidental fall, for example during transportation, the primer 7 which is urged forwardly by the effect of inertia comes to bear against the edge 37 and cannot come into contact with the point 36 of the striker 32. This arrangement therefore provides a perfect safety measure in respect of an accidental fall.

At the beginning of the launch, the striker 32 is subjected to the same acceleration as the projectile and is urged rearwardly, moving the spring lugs 35 which held it in an active position against the wall of the member 33, until the shoulder 38 of the striker 32 comes into contact with the radial surface 39 provided by the ring 34. The spring lugs 35 return to their initial locking position, thus preventing the striker 32 from moving forwardly again at the moment of impact, as shown in FIG. 7. The point 36 of the striker 32 is then rearwardly with respect to the rearward circular edge 37 of the ring 34 and is therefore in an active position ready to come into contact with the primer 7 upon impact.

Figure 8:
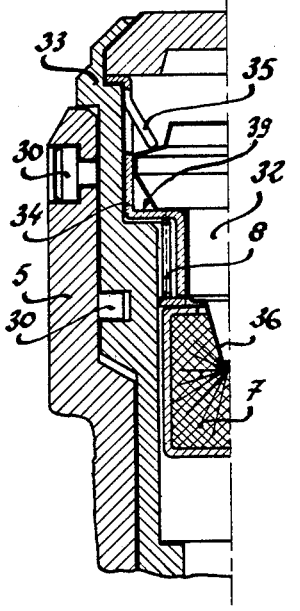

Upon impact, and as already described above with reference to the first embodiment, the striker 32 which is then fixed with respect to the member of revolution 33 is urged rearwardly after shearing of the locking pin 30 and the washer 31, and the primer 7, by virtue of its inertia overcoming the action of the spring 8, strikes against the point 36 of the striker 32, as shown in FIG. 8; as in the first embodiment, explosion of the primer 7 causes explosion of the detonator 12 and thus the explosive charge 4.

In addition, in this second embodiment, the member of revolution 33 has an extension portion 40 (see FIG. 6) which extends into the interior of the casing 11, at the forward end of the cover 15 of the detonator 12. The extension portion 40 is not hollow, like the forward portion of the member 33, and serves as a physical barrier for preventing the explosive action from being transmitted to the detonator 12 in the event of the primer 7 accidentally going off. On the other hand, it has passages 41 which are intended to form a firing passage when the member 33 has been urged rearwardly upon impact and the extension portion 40 is completely within the casing 11.

Finally, as shown also in FIG. 6, the spring ring 42 for locking the detonator 12 in the active position in the case member 18 is of rectangular section as also is the groove 43 which is provided in the rearward inside surface of the casing 11 and which is intended to receive the spring ring 42.

The percussion head fuse for an explosive projectile, in accordance with the invention and as described by way of example with reference to the accompanying drawings, has many advantages, of which a very simple construction involving a small number of components which are assembled on an axial system, while nonetheless providing all the safety measures required, reduced size and low weight, may be emphasised. Moreover, the fuse can be removed and stored separately from the remainder of the projectile. It may for example be housed within the tail of a grenade contained in its transportation box.

The embodiments of the invention in which an exclusive property or privilege is claimed are defined as follows:

1. A percussion head fuse for an explosive projectile, comprising a cylindrical body, fixing means on the rear end of the cylindrical body to attach the cylindrical body to the forward end of a projectile containing an explosive charge, a case member extending axially beyond said body and being adapted to be disposed in the operating position within said explosive charge of the projectile, a detonator comprising casing means having a rearward portion which is closed and reinforced and serves as armor plating, a casing disposed coaxially within said cylindrical body, means releasably locking said casing means within said casing in a position in which said detonator is forward of said case member and said reinforced armor plating shields said explosive charge from said detonator, means yieldably urging said detonator toward an armed position within said case member, and means for releasing said releasable locking means, said releasing means comprising an inertia weight member slidably mounted in said cylindrical body for successive movement between first, second and third positions, said weight member in said first and second positions retaining said locking means in a position to prevent rearward movement of said detonator into said case member, said weight means moving to said second position rearwardly by inertia when said projectile is fired and from said second position forwardly to said third position, said weight means in said third position releasing said locking means to permit rearward movement of said detonator into said case member, and resilient means urging said weight member forwardly toward said first and third positions.

2. A fuse as claimed in claim 1, and a primer mounted in the forward end of said casing, a striker also mounted in the forward end of said casing, means yieldably urging said striker and primer apart, and means mounting said striker and primer for movement relative toward each other by inertia under impact to strike each other to detonate said primer which in turn detonates said detonator which in turn detonates said explosive charge.

3. A fuse as claimed in claim 1, said locking means comprising at least one ball disposed in a recess through said casing and which on one side engages said detonator in locking relationship and on the other side is pressed into locking relation with said detonator by said weight member in said first and second positions, said weight member having a recess therein that permits said at least one ball to move out of locking engagement with said detonator in said third position.

4. A fuse as claimed in claim 1, and means for locking the detonator in the active position in the case member.

5. A fuse as claimed in claim 4, the last-named locking means comprising a spring ring disposed in a circular groove in the outside surface of the detonator and a circular groove in the inside surface of the rearward end of the casing, said spring being partially engaged in said groove when the detonator is in the active position within the case member.

6. A fuse as claimed in claim 1, and means for guiding said weight member from said first position to said second position, and from said second position forwardly to said third position along a path distinctively different from the path followed by said weight member between said first and second positions, said guide means comprising pin and slot means carried by said weight means and said casing, said slot means having forwardly diverging legs an upper portion of one of which receives said pin means in said first position and an upper portion of the other of which receives said pin means in said third position.

7. A fuse as claimed in claim 6, said other leg of said slot means having zig-zag portions for retarding the movement of said weight member from said second position to said third position.

* * * * *